United States Patent [19]

Thieffry

[11] 4,249,358

[45] Feb. 10, 1981

[54] PROCESS AND INSTALLATION FOR MOULDING PAVING STONES OR SLABS

[75] Inventor: Luc Thieffry, Barcelona, Spain

[73] Assignee: "P.B.I." Procedes et Brevets Industriels, Luxembourg, Luxembourg

[21] Appl. No.: 924

[22] Filed: Jan. 4, 1979

[30] Foreign Application Priority Data

Jan. 6, 1978 [FR] France ..... 78 01017

[51] Int. Cl.[3] ..... B28B 1/04; B28B 3/04; B28B 3/08

[52] U.S. Cl. ..... 52/745; 52/747; 264/297; 264/333; 264/334; 404/99; 425/195; 425/428; 425/434

[58] Field of Search ..... 425/182, 183, 425, 428, 425/430, 431, 434, 448, 193, 195, 469, 452, 468; 249/119, 122, 123, 124, 125, 129, 131, 132; 52/747, 745; 404/83, 99; 264/297, 299, 333, 334

[56] References Cited

U.S. PATENT DOCUMENTS

| | | | |
|---|---|---|---|
| 839,125 | 12/1906 | Dyer | 425/468 |
| 1,711,359 | 4/1929 | McIntyre | 404/99 |
| 3,203,069 | 8/1965 | Wogulis et al. | 264/261 |

FOREIGN PATENT DOCUMENTS

| | | | |
|---|---|---|---|
| 883932 | 10/1971 | Canada | 425/183 |
| 2611641 | 9/1977 | Fed. Rep. of Germany | 425/183 |
| 2718066 | 2/1978 | Fed. Rep. of Germany | 404/99 |

*Primary Examiner*—W. E. Hoag

*Attorney, Agent, or Firm*—Murray and Whisenhunt

[57] ABSTRACT

Method and apparatus for forming and laying paving blocks in which interchangeable grids are provided of dissimilar configuration comprising a plurality of mould cavities each enclosing one or more fixed centers of the modules of the pattern, whatever is in the conformation of the said grids. The modular and transformable ramming assembly comprises a plurality of fixed securing points distributed to correspond to the fixed centers of the modules of the mould pattern and intended for the removable fitting of ramming plates of forms and dimensions analogous with those of the underlying cavities of the selected grid. The changing of forms and/or dimensions of the moulded paving stones or slabs is effected by replacing one grid by another differently conformed grid and by fixing new removable ramming plates corresponding to the forms and/or dimensions of the cavities of the new grid, by means of the said fixing points.

16 Claims, 24 Drawing Figures

PROCESS AND INSTALLATION FOR MOULDING PAVING STONES OR SLABS

BACKGROUND TO THE DISCLOSURE

The present invention relates to a process and an installation for the moulding and mechanical or semi-mechanical laying of standardised paving stones or slabs of concrete or other material.

More precisely the object of the invention concerns especially a method and an apparatus permitting the formation at industrial rates of paving stones, slabs and other elements, providing the faculty of imparting a great variety of forms to them, for each of the numberless realisable modules, without the application of complex technical means.

It is emphasised that the invention applies advantageously to interlocking paving stones or slabs equipped with protruding or re-entrant parts on at least two lateral faces of the largest inscribed rectangular parallelepiped, or to paving stones or slabs without connection, that is to say comprising no interlocking or shoulders.

The traditional process for the moulding of unconnected or interlocking paving stones or slabs consists generally of a one-piece mould and a similarly one-piece rammer. These two parts are heavy and relatively expensive.

For the manufacture of a great variety of forms of paving stones or slabs a large number of moulds and rammers is needed, and this number must also be multiplied by the various desired thicknesses, most frequently 6, 8, 10 and 12 cm.

For the manufacture of bricks, machines are known which comprise a mould comprising individually removable cores and separations, so as to permit a change of the forms and/or dimensions of the moulded bricks, while the rammer comprises removable protruding parts capable of being replaced to correspond to the form of the cavities of the mould therebeneath.

However the changes of forms and dimensions are effected empirically and necessitate a separate dismantlement of each core and separation previously positioned in the mould, and the separate installation of each new core or separation. Under these circumstances such machines can at most be suitable for the simultaneous moulding of 1 to 4 construction elements, but are absolutely not appropriate to the simultaneous moulding of a large number of elements.

OBJECT OF THE INVENTION

Thus one object of the present invention is to make up for the shortcomings of the traditional methods and apparatuses.

One objective pursued by the process and the installation according to the invention is the realisation of a multipurpose mould-rammer assembly of simple design and operation, permitting the production of paving stones or slabs of various configurations, in large numbers and at industrial rates.

Another aim of this process and this installation is to permit a rapid and methodical adaptation of the mould-rammer assembly in accordance with the forms and dimensions selected for the paving stones or slabs.

A further result obtained by the application of the modular moulding method according to the invention is the permitting of the fully mechanical or semi-mechanical laying of the produced paving stones or slabs.

SUMMARY OF THE INVENTION

According to the invention there is provided an installation for the molding of paving stones or slabs from moldable material, comprising a grid carrier, a grid of a set of differently shaped interchangeable grids removably mounted on said grid carrier, said grid and said carrier forming a mold having a plurality of mold cavities, a support member, and a plurality of removable ramming plates mounted on said support member above said grid, which plates are interchangeable and selected in order that they correspond in shape and dimensions to the shape and dimensions of the underlying mold cavities.

Further according to the invention there is provided a process for the molding of paving slabs comprising selecting one grid from a set of interchangeable grids of dissimilar configuration each having a plurality of mold cavities arranged in a pattern with the cavities spaced apart on predetermined centres, mounting said selected grid on a grid carrier, selecting a plurality of ramming plates conforming in shape and dimensions to the cavities of the selected grid, mounting said ramming plates above said grid with each plate disposed above its respective cavity, charging said cavities with settable moldable material, and thereafter effecting relative movement between said plates and said cavities to effect ramming of the moldable material by said ramming plates.

According to a further characteristic the fixing point or points of the removable ramming plates are distributed to correspond to the fixed centres of the modules of a specific pattern from which the interchangeable through-apertured grids are realised, in such manner that when the mould is constituted one or more of these fixed centres is or are enclosed in the mould cavities.

The process for the mechanical or semi-mechanical laying of the slabs or paving stones according to the present invention is distinguished mainly in that the plates of modular moulded paving stones or slabs are grasped and deposited by means of a handling device provided with a plurality of suction cups distributed in such manner that their centres correspond to the fixed centres of the modules of the pattern of the mould.

BRIEF DESCRIPTION OF THE DRAWINGS

These and further purposes and characteristics will appear more clearly from the following description and from the accompanying drawings, wherein:

In FIGS. 1 to 10, the drawing in fine lines illustrates patterns from which grids can be realised, while the drawing in thick lines represents examples of grids executed according to certain lines of the said patterns.

FIG. 12 is a cross-section of this mould while

DESCRIPTION OF PREFERRED EMBODIMENT

Figure 1:
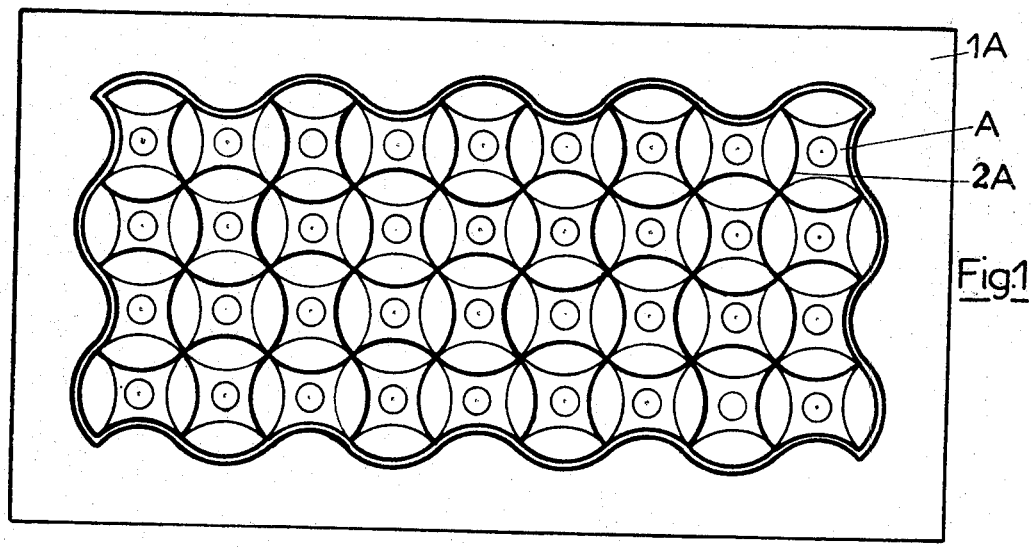
FIGS. 1, 4 and 7 are plan views of different grid-carriers in which interchangeable grids are installed which are realised according to three different modular patterns.
Figure 2:
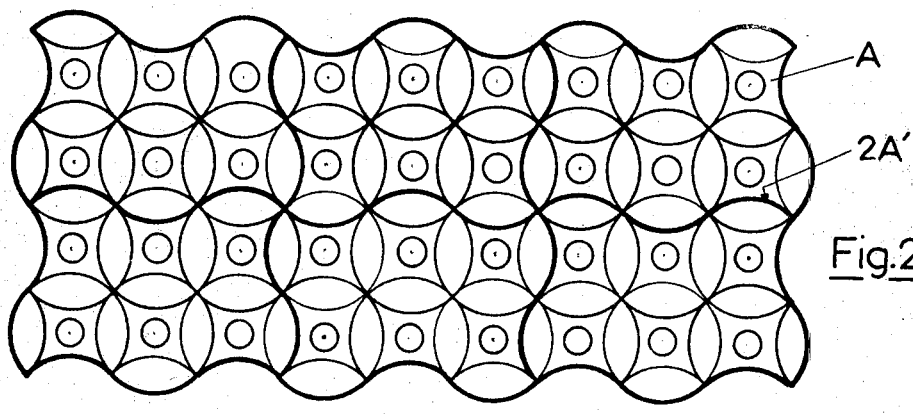
FIGS. 2 and 3, 5 and 6, 8 and 9 are plan views of interchangeable grids realised according to three different modular patterns and comprising a variable number of mould cavities.

Reference will be made to the said drawings for the description of the examples of application of the process and of realisation of the moulding and mechanical or semi-mechanical laying installation according to the present invention, these examples of course having no limitative character.

The process according to the invention is characterised firstly in that, for a support or grid-carrier 1, 1A, 1B, 1C, from a modular pattern where each module is provided with a fixed centre designated by a circle ○ (FIGS. 1 to 10) or by the reference + (FIGS. 11 and 20) interchangeable through-apertured grids are realised each comprising a plurality of mould cavities 3 containing one or more of these fixed centres ○ or + of the modules, whatever may be the conformation and/or disposition of the walls or partitions of the said grids, and further in that a transformable modular rammer is executed comprising a plurality of fixed securing points the centres ○ or + of which are distributed to correspond to the centres ○ or + of the modules of the pattern of the mould and intended for the removable fitting of ramming plates 4 of forms and dimensions analogous with those of the cavities 3 of the grid in position, so that by replacing one grid by another of different design and by changing the plates 4 one obtains a variation of the forms and dimensions of the moulded paving stones or slabs.

The external dimensions of the grip-carriers 1, 1A, 1B, 1C according to FIGS. 1, 4, 7 and 11 are determined by the dimensions of the machine on which they are to be fitted.

The internal division of these grid-carriers, slightly to the exterior, follows the lines of the corresponding pattern in such manner that there is the maximum possible number of entire modules contained in this division, this number also being affected by the dimensions of the grid-carrier and the capacity of the machine. The internal partitions of the grids 2A, 2B and 2C follow exactly the lines of the pattern utilised for the division of the corresponding grid-carriers.

For better understanding of the examples, the internal partitions of the grids 2A, 2B and 2C have been designed to divide them into as many mould cavities as there are modules of the pattern contained in the grids. These partitions exactly follow the lines of the corresponding patterns. Each mould cavity contains a fixed centre of the module of the pattern. The circle ○ surrounding these fixed centres indicates the tube which retains the ramming plates conforming with the configuration of the cavity. The interchangeable grid 2A' in FIG. 2, designed to be installed in the grid-carrier 1A, contains 36 modules of the pattern A and is divided into 6 identical mould cavities each of 6 modules, each cavity containing 6 fixed centres of the modules of the pattern A.

Figure 3:
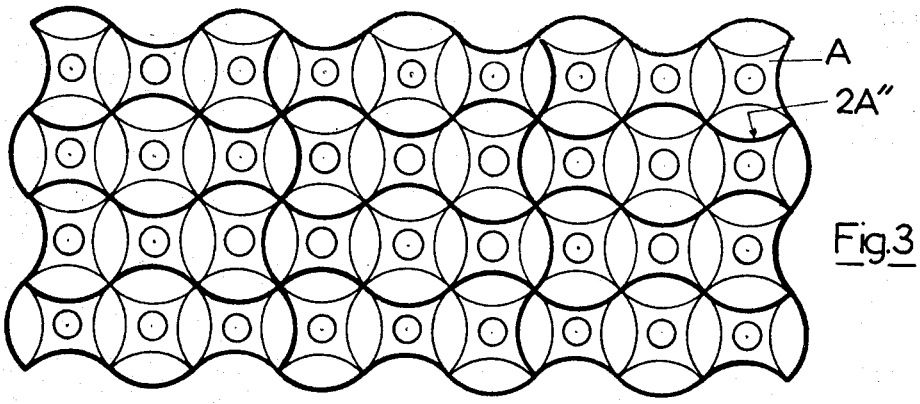

The interchangeable grid 2A" in FIG. 3, intended to be installed in the grid-carrier 1A, contains 36 modules of the pattern A and is divided into 12 mould cavities of 3 modules, 6 of one form and 6 of another form, each cavity containing 3 fixed centres of the modules of the pattern A.

Figure 5:
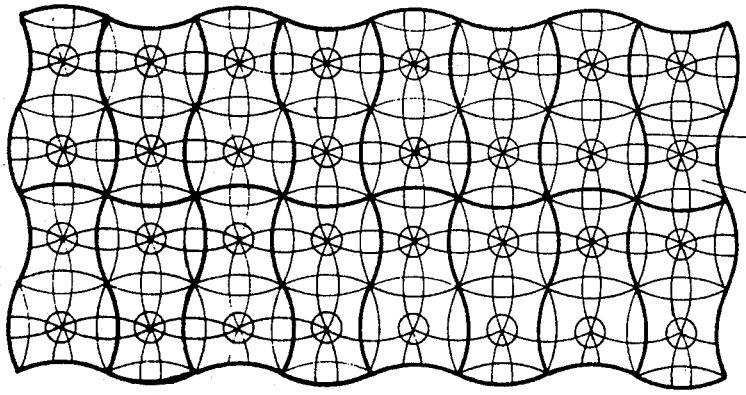

The interchangeable grid 2B' in FIG. 5, intended to be installed in the grid-carrier 1B, contains 32 modules of the pattern B and is divided into 16 identical mould cavities of 2 modules, each cavity containing 2 fixed centres of the modules of the pattern B.

Figure 6:
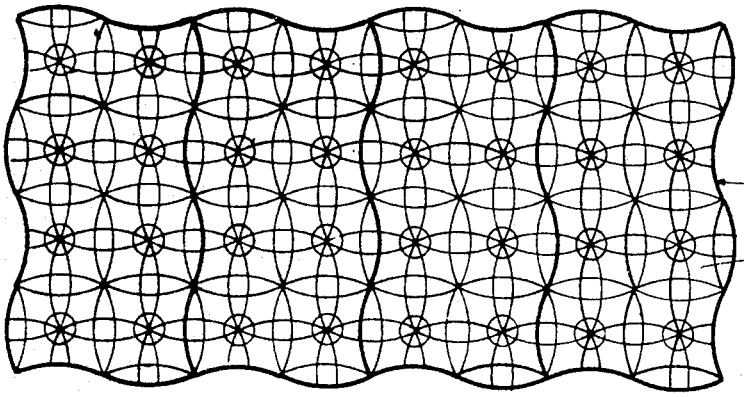
Figure 7:
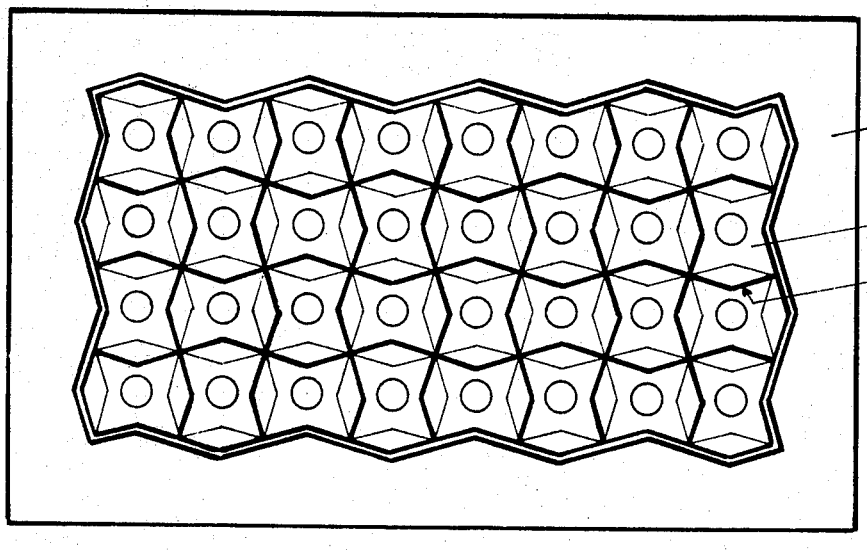

The interchangeable grid 2B" in FIG. 6, intended to be installed in the grid-carrier 1B, contains 32 modules of the pattern B and is divided into 4 identical mould cavities of 8 modules, each cavity containing 8 fixed centres of the modules of the pattern B.

Figure 8:
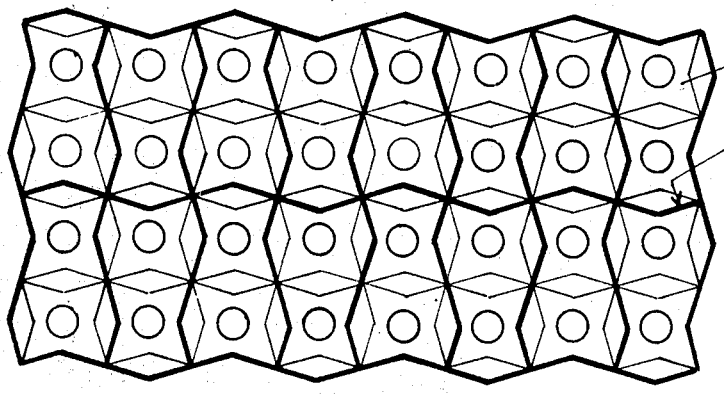

The interchangeable grid 2C' in FIG. 8, intended to be installed in the grid-carrier 1C, contains 32 modules of the pattern C and is divided into 16 identical mould cavities of 2 modules, each cavity containing 2 fixed centres of the modules of the pattern C.

Figure 9:
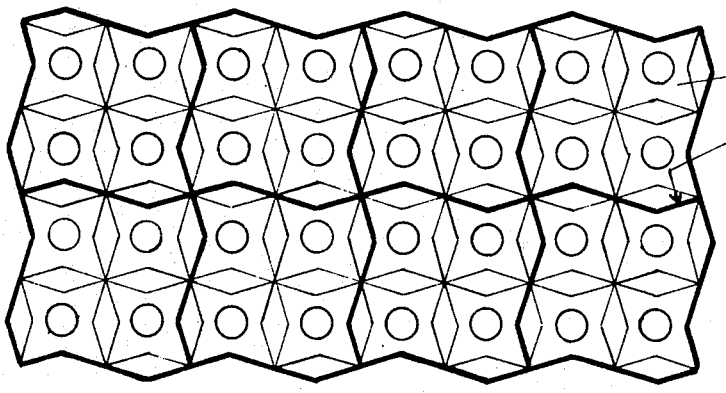

The interchangeable grid 2C" in FIG. 9, intended to be installed in the grid-carrier 1C, contains 32 modules of the pattern C and is divided into 8 identical mould cavities of 4 modules, each cavity containing 4 fixed centres of the modules of pattern C.

According to one of the characteristics of the invention the interchangeable grids are formed for example by means of strips of steel or other material, cut out to the necessary width and corresponding to the height of the paving stone or slab plus the height of compression by the rammer.

These strips are then curved or folded along the lines of one of the numberless modular patterns which can be used for this purpose, or left in their original straight condition to permit the execution of special pieces, such as edge or angle paving stones or slabs etc.

Figure 4:
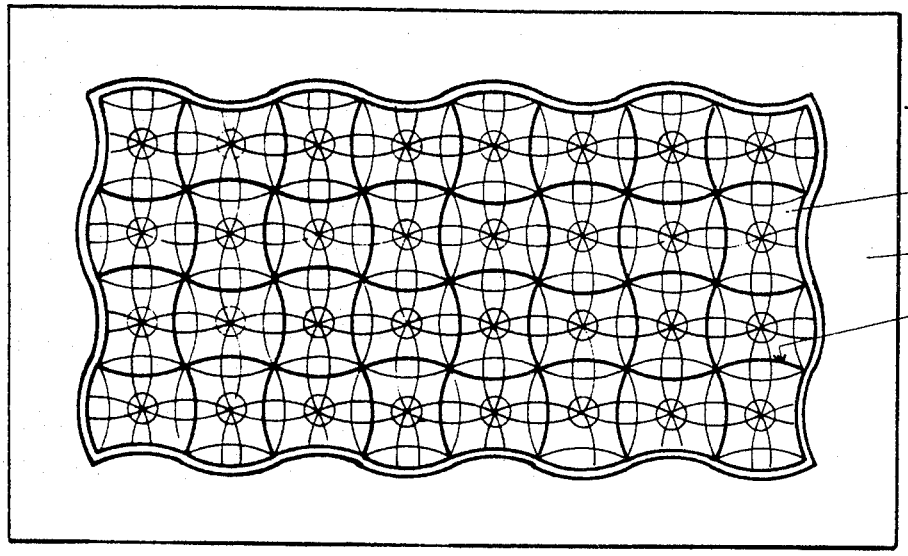
Figure 10:
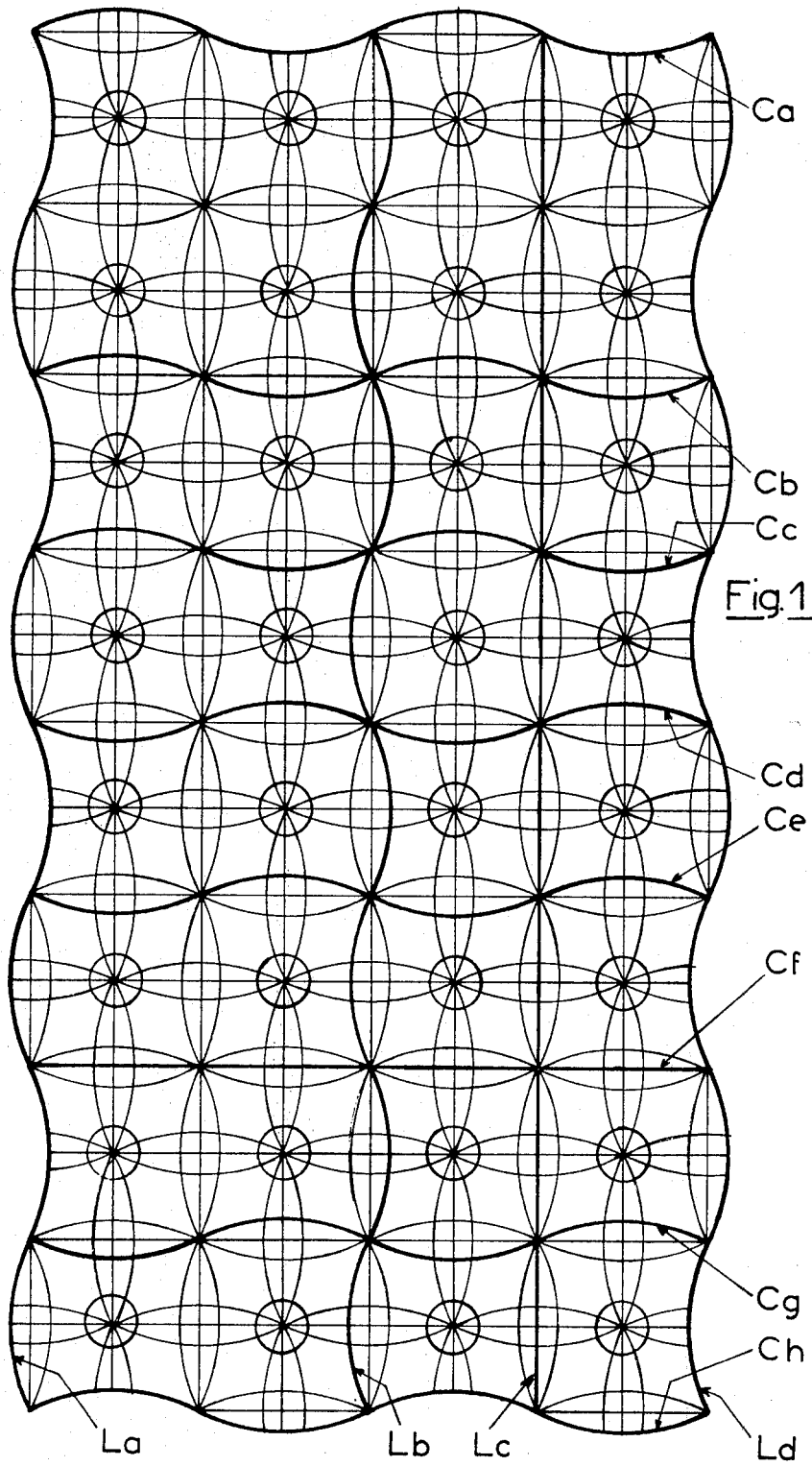
FIG. 10 is a plan view of an example of a grid formed from the pattern illustrated in FIGS. 4, 5 and 6, intended to show various possibilities of positioning of the internal partitions of an interchangeable grid for the formation of mould cavities of different configurations each containing 1,2, or 4 fixed centres of the modules of the said pattern.

FIG. 10 is an example of the modular pattern B by means of which a grid of 32 modules is formed the peripheral configuration of which permits its installation in the grid-carrier 1B in FIG. 4.

The long profiled strips La, Lb and Ld are identical and their undulations are disposed parallel. The long straight strip Lc illustrates the manner of obtaining edge paving stones or slabs, and by intersection with the short straight strip Cf, the manner of obtaining angle paving stones or slabs.

The short profiled strips Ca, Cb, Cc, Cd, Ce, Cg and Ch are all identical but are not all disposed in the same direction. While Ca, Cb, Cc and Ch have their undulations parallel, the strips Cd, Ce and Cg have been reversed.

Another difference in the arrangement of the short strips is noted at the intersection angles with the long strips, in fact the short strips Ca, Cb, Ce, Cg and Ch form an angle of 90° with the long profiled strips La, Lb and Ld, which is not the case with the short strips Cc and Cd.

The short straight strip Cf illustrates the manner of obtaining edge paving stones or slabs and, by intersection with the long straight strip Lc, the manner of obtaining angle paving stones or slabs.

The conformation of this grid, which it would not be practical to utilise, is intended to show the numberless possibilities offered by the invention. It is divided into 21 mould cavities of which 16 are of different configurations and 5 are repetitions, each cavity containing 1, 2 or 4 fixed centres of the modules of the pattern B.

The moulding installation is noteworthy especially in that it comprises:

on the one hand a mould constituted by a constant grid-carrier for a specific module and by one of the grids of an assortment of differently conformed, interchangeable, modular grids;

on the other hand a modular and transformable rammer comprising a plate support carrying a plurality of removable ramming plates of forms and dimensions corresponding to the forms and dimensions of the mould cavities.

The above-mentioned 2 systems of fitting of the moulding installation will be described below.

The mould (FIGS. 11 to 16) comprises a grid-carrier 1, always the same for a specific module, whatever are the forms of the paving stones and their dimensions and whatever is the desired thickness.

Figure 11:
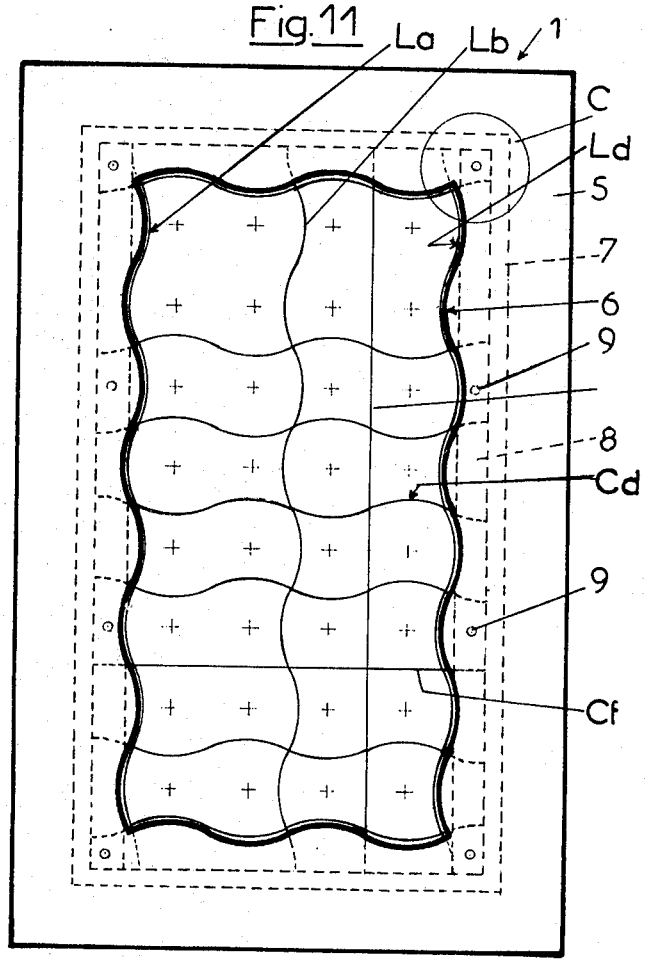
FIG. 11 is a plan view of a mould provided with an interchangeable grid according to the invention.

This grid-carrier is constituted by an upper sheet 5 having the required thickness and strength, comprising a central opening 6 the edges of which have been marked in heavy lines in FIG. 11.

In view of the fact that the interlocking paving stones or slabs for the manufacture of which the invention is particularly intended generally comprise protruding or receding sides, the edges of the opening 6 will most frequently have the form of a sinusoid of that of a broken line.

Beneath the upper sheet 5 there is attached, by welding or otherwise, a reinforcing frame 7 intended to increase the rigidity of the grid-carrier.

The grid-carrier as represented by way of example in FIG. 11 is designed to receive a grid formed on the basis of a pattern of 32 modules the centres of which are designated by the reference +. The number of modules of a grid depends upon the dimensions of the adopted module and the effective working area of the moulding machine.

An interchangeable grid cast in one piece or cut from a block of metal or other material by any means, or formed by assembly of several elements which are either cast separately or cut separately from a block of metal or other material, can be strongly fastened to the grid-carrier by any means permitting the rapid replacement of one interchangeable grid by another, preferably without the need to withdraw the grid-carrier from the moulding machine.

An interchangeable grid constructed according to one of the characteristics of the invention by means of strips of steel or other material, straight or profiled according to the lines of a modular pattern, is advantageously formed and firmly fastened to the grid-carrier in accordance with the means as illustrated in FIGS. 11, 12, 13, 14, 15 and 16.

Figure 12:
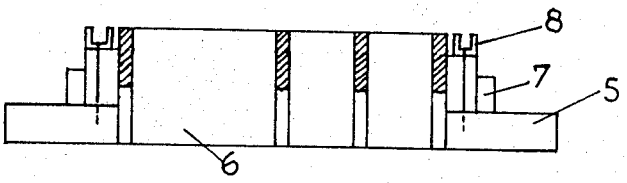
Figure 13:
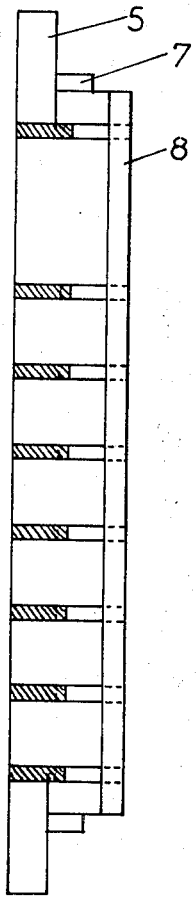
FIG. 13 is a longitudinal section thereof.

The interchangeable grid placed in the grid-carrier as illustrated in FIGS. 11 to 13 corresponds to the grid in FIG. 10.

The length of the long or short strips constituting the grids, plus about 0.5 mm. represents the spacing between two opposite sides of the reinforcing frame 7 of the support sheet 5.

Figure 14:
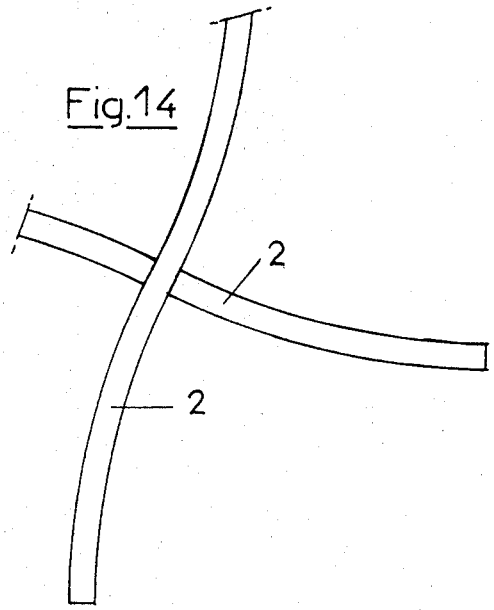
FIG. 14 is a detail view showing the intersection of two sinusoidal strips.
Figure 15:
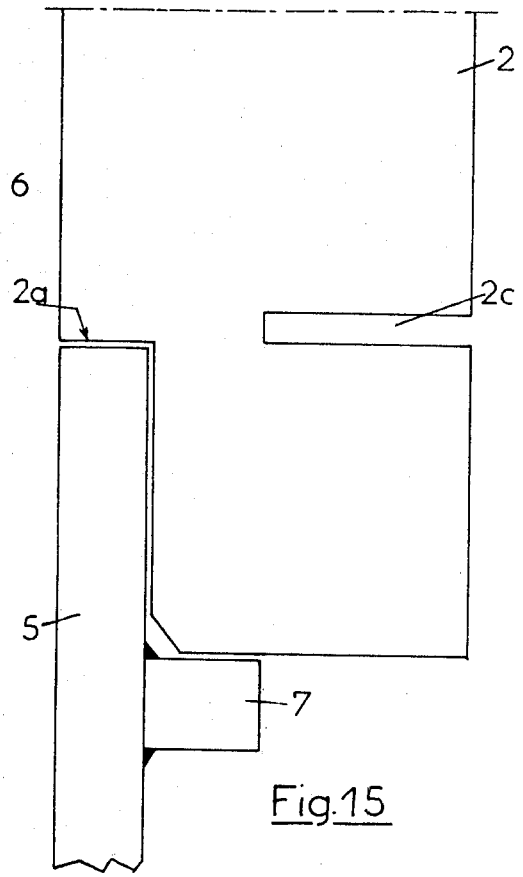
FIG. 15 is a detail view illustrating the junction of a long strip extremity with the corresponding edge of the grid-carrier.
Figure 16:
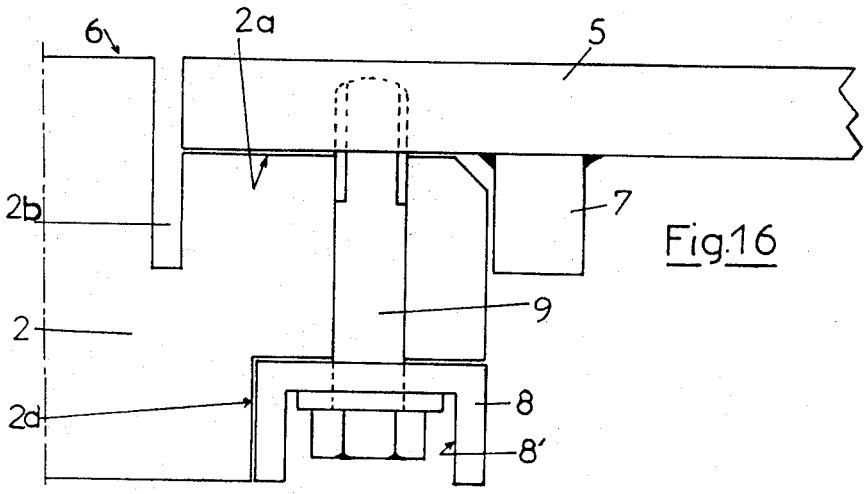
FIG. 16 is a detail view showing the system permitting of rigidly fastening the extremities of the short strips and the grid-carrier.
Figure 17:
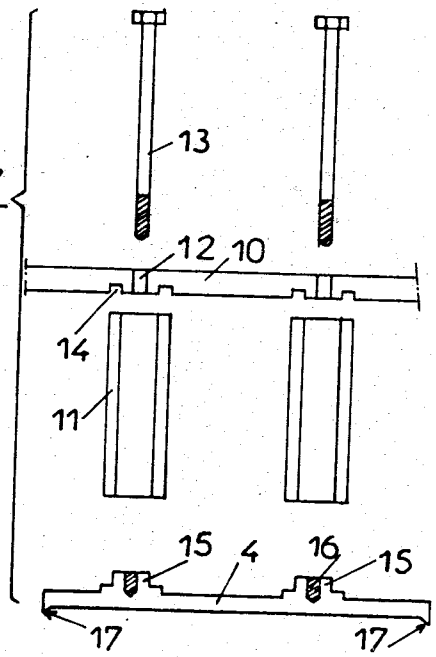
FIG. 17 is an exploded sectional view of the elements constituting the ramming assembly.
Figure 18:
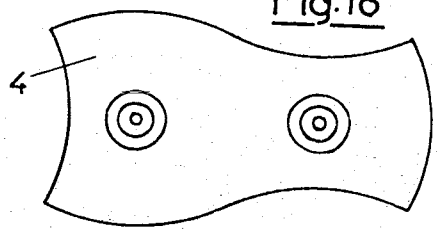
FIG. 18 is a plan view of a ramming plate.

FIGS. 14 to 16 show the details of the angle C of the mould as represented in FIG. 11.

The upper angles of the extremities of the strips 2, long or short, comprise a notch 2*a* which permits the grid to fit into the frame constituted by the grid-carrier, so that the upper edges of the said strips are at the level of the upper surface of the sheet 5 of the grid-carrier or preferably slightly below it (by 0.5 to 1 mm.), the latter in order to avoid the filling slider of the machine abutting upon the strips of the grid when the said sheet has been subjected to a certain wear. At the regions of intersection with the long strips the short strips are slotted over the upper half of their height. These slots 2*b* are formed at the exact angle of intersection; they have a width corresponding to the thickness of the long strips, so that the interlocking engagement is tight.

In an analogous and complementary manner at the regions of intersection with the short strips, the long strips are slotted over the lower half of their height. These slots 2*c* are executed at the exact angle of the intersection; they have a width corresponding to the thickness of the short strips so that the interlocking engagement is tight.

A simple system conveniently and rapidly permits of solidly and rigidly fixing the grids in the grid-carrier; the change of grid can be effected without withdrawal of the grid-carrier from the moulding machine.

This system comprises a pair of fixing bars 8 each constituted by a profiled piece having for example a U-section. These profiled pieces are disposed longitudinally, in opposite manner, and fit into a notch 2*d* which the lower angles of the opposite extremities of the short strips possess.

The groove 8' of the fixing bars is oriented from the lower side of the mould and permits the lodgement of the heads of the fixing bolts 9 which are screwed into blind bores formed in the sheet 5 and opening on the lower face of the latter.

It will be understood that these bolts permit of clamping the short strip extremities tightly between the two U-profiles and the upper sheet of the grid-carrier, and consequently of making the grid and the said grid-carrier rigidly fast with one another.

When the concrete has been vibrated and compressed by the rammer inside the grid, the mould is pushed upwards while the plates of the rammer remain immobile, in order to force the moulded elements to emerge from the cavities downward. Thus it will be understood that the greatest force to which the grid is subjected is that of removal of the moulding from the mould.

It is for this reason that the short strips are grooved in their upper part in order that it may be they which support the downward thrust imposed on the long strips, in mould discharging.

The whole of the force is thus transmitted to the two U-profiled parts and thence towards the support sheet of the grid-carrier through the intermediary of the bolts.

The ramming assembly is illustrated in FIGS. 17 to 20. It is constituted by a modular ramer composed of interchangeable parts including mainly:

A plate support 10, a plurality of removable ramming plates 4 and a plurality of columns 11 connecting the said ramming plates to the said plate support. The plate support 10 is drilled right through at points corresponding to the centres of the modules of a pattern identical with the pattern of the mould, the drillings 12 thus formed serving for the passage of the fixing bolts 13 of the ramming plates 4. A circular lodgement 14 is cut in the lower surface of the plate support, around each module center realised by a drilling 12. These lodgements permit the fitting in of the upper extremities of the cylindrical columns 11, so that the latter may be perfectly centered and remain strictly in the axis of the module, over their entire height.

The plate support 10 carries as many columns 11 as there are module centres.

The length of the columns is designed for the greatest thickness of paving stones; thus they can be used for all the slighter thicknesses of paving stones or slabs.

A fixing bolt 13 passes through each drilling 12 and each column 11. As the length of the columns is invariable, that of the bolts is likewise.

It will be understood that for a specific module the plate support 10, the plate carrier columns 11 and the bolts 13 are suitable in all cases, whatever may be the forms of the paving stones or slabs and their dimensions (number of modules) and whatever is the thickness of the paving stones which it is desired to manufacture.

The columns 11 and the bolts 13 carry the removable ramming plates 4.

The number of ramming plates fastened to the columns 11 corresponds to the number of cavities of the mould; the form and dimensions of each plate 4 are in conformity with the form and dimensions of the underlying cavity of the mould, with a slight clearance.

Figure 20:
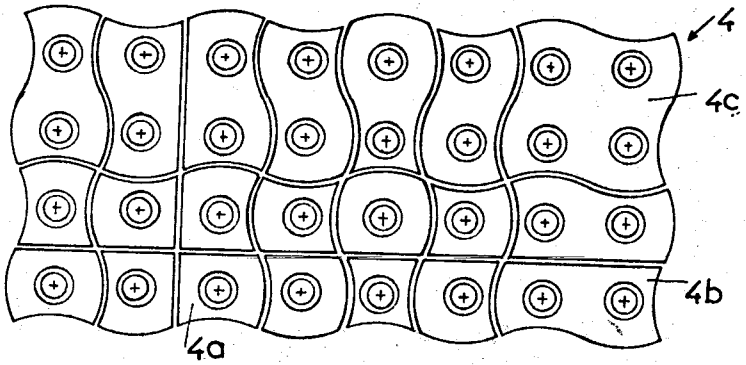
FIG. 20 is a section along the line 20—20 in FIG. 19.

According to the dimensions of the paving stones or slabs to be realised, a ramming plate will be fixed, as shown by FIG. 20, by one column (as in the case of the plate 4*a*), by two columns (plate 4*b* for example), by three columns, by four columns (plate 4*c*) or by a greater number of columns.

The ramming plates are different according to the forms and dimensions of the paving stones or slabs to be formed, but they are suitable for all thicknesses of one and the same form of paving stones.

On their upper faces the ramming plates are provided with one or more cylindrical nipples 15 according to the dimensions of the said plates. The number of these nipples is a function of the number of modules included by each plate.

Each nipple is disposed to correspond to the centre of a module and is machined over a certain height in order to lodge perfectly in the lower extremity of the appropriate column. The centre of each nipple comprises a tapping 16 into which the threaded extremity of a bolt 13 is screwed, permitting of rigid fixing of the ramming plates and the columns in the desired position.

If necessary the lower face of each ramming plate possesses a peripheral protuberance 17 of triangular section for the formation of a chamfer on the upper face of the paving stone.

It will be understood that the arrangement as just described permits easy and rapid installation of ramming plates of forms and dimensions corresponding to the forms and dimensions of the underlying mould cavities which are a function of the interchangeable grid selected for the shaping of the paving stones or slabes to be produced. The changing of ramming plates is affected without the necessity of withdrawing the plate support from the moulding machine. By changing the grid of the mould any by fitting the appropriate ramming plates it is possible to realise a very great variety of paving stones or slabs, in a rational and methodical manner.

The ramming assembly as represented in FIG. 20 is constituted on the basis of a pattern of 32 modules comprising a plate of 4 modules, eight plates of 2 modules and 12 plates of 1 module. This rammer corresponds to the grid according to FIG. 11, which is identical with the grid appearing in heavier lines in FIG. 10.

Figure 19:
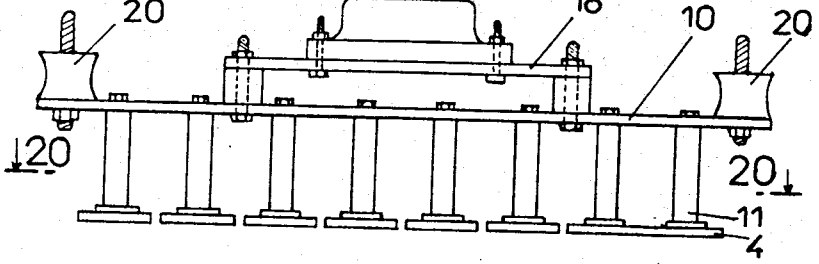
FIG. 19 is a side view of the ramming assembly.

As FIG. 19 shows, a bridge 18 is mounted for example by bolting on the plate support 10. The vibrator 19 intended to facilitate the formation of the chamfer and to ensure a certain smoothing of the visible face of the paving stone is installed on this bridge. On the upper face of the plate support there are also installed vibration dampers 20, of rubber or other elastic material, to the number of 4, 6 or 8 for example, according to the dimensions of the said plate support. These dampers serve for the fixing of the plate support to the bridge (not shown) of the moulding machine; they prevent vibrations from being transmitted to the whole of the press.

In order that the description and drawings may not be unnecessarily complicated, in the present patent the various equipment and elements of the moulding machine which do not come within the scope of the invention will not be described.

The modular techniques utilised in the process and the installation as claimed, in addition to the already cited advantages, provides the advantage of permitting fully mechanical or semi-mechanical laying of the moulded paving stones or slabs.

The mutally complementary process and installation designed for this purpose are possible only by virtue of the fixedness of the centres of the modules of the pattern of all the grids which can be utilised on one and the same press for one and the same modular pattern.

According to this process the plates of moulded modular paving stones or slabs are grasped and deposited by means of a handling device provided with a plurality of suction cups distributed in such manner that their centres correspond to the fixed centres of the modules of the pattern of the mould.

Figure 21:
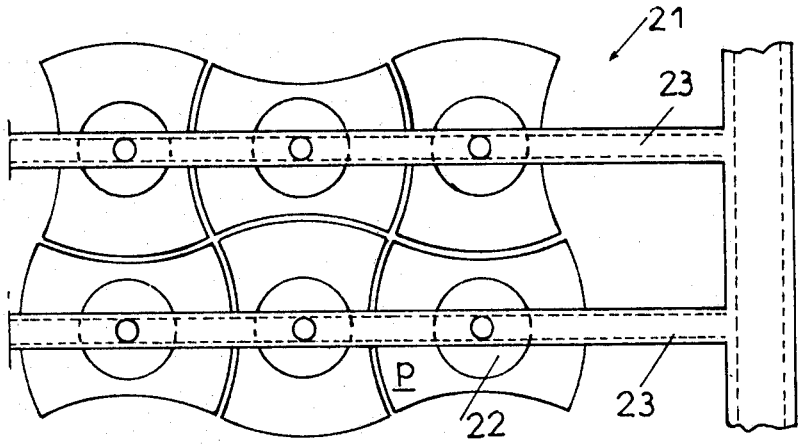
FIG. 21 is a plan view of a means capable of being used for the mechanical or semi-mechanical laying of the paving stones or slabs.
Figure 22:
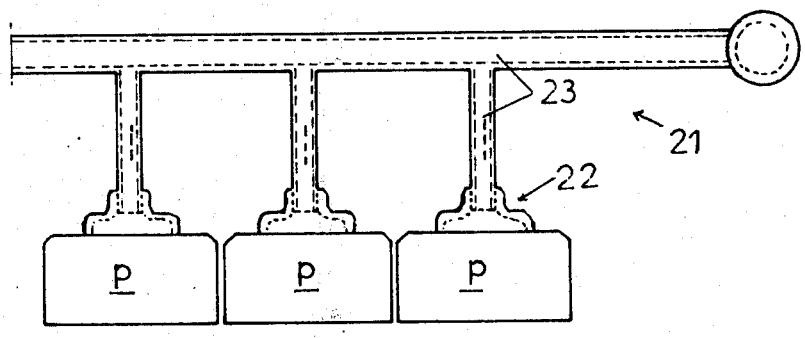
FIG. 22 is a side view of a means of this kind.

The installation for carrying out this process thus comprises a frame 21 (partially represented in FIGS. 21 and 22) equipped with a plurality of suction cups 22 distributed so that their centres correspond to the fixed centres of the modules of the adopted mould pattern. The frame 21 is fixed to or suspended from a mobile handling contrivance equipped with a suction fan connected to the cups 22, through the intermediary of appropriate conduits 23, and sufficiently powerful so that each suction cup can support the weight of a module despite a certain air permeability of the concrete.

It will be understood that for a given pattern of n modules, the number and distribution of the centres of these modules will be the same for the cavities of the mould, for the ramming plates and for the suction cups which thus will permit the handling of the moulded paving stones or slabs, whatever may be the form and dimensions of these latter which are always executed on the basis of the selected module or a multiple of this module.

Thus if one considers the example as illustrated in FIGS. 10 and 11, where the grid used includes 32 modules, the assembly of paving stones or slabs moulded with the aid of this grid forms a plate of 32 modules.

Such plates can be palletised and taken up again from the pallets in order to be laid to form the pavement, by means of a frame equipped with 32 suction cups and centres of which will correspond exactly to the centres of the modules of the grid which served for the formation of the said plates.

If it is desired to benefit from the advantages of mechanical or semi-mechanical laying, it is appropriate to construct the grids so that the plates of paving stones or slabs moulded form a design or motif ready for laying.

Figure 24:
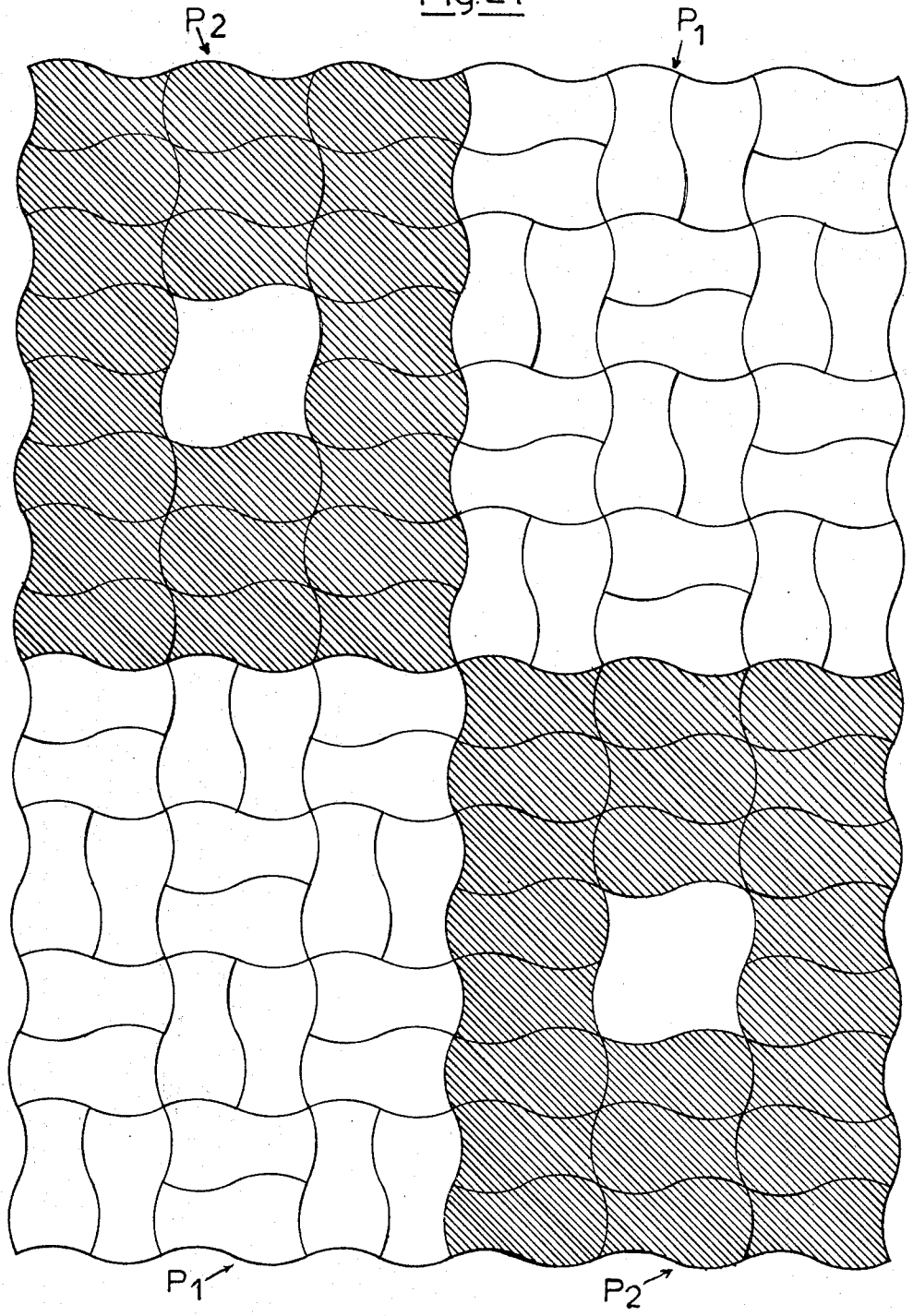
FIG. 24 is a plan view showing an assemblage of mechanically or semi-mechanically laid paving stones or slabs.

FIG. 24 gives an example of paving formed by the mechanical laying of plates P1 and plates P2 in combination .

The plates P1 have a first coloration and comprise 24 paving stones of two modules disposed in chess-board manner, while the plates P2 have a second coloration and comprise 22 paving stones of two modules. In this example the four centre modules of the plates P2 have not been filled during manufacture, thus the paving must be completed by manual laying of one or more paving stones in each empty space, forming a total of 4 modules of complementary form and possiblity of different coloration. The empty spaces left in the plates of paving stones, in manufature, are obtained by closing one or more cavities of the grid by a sheet. This sheet is welded to the four strips forming the cavity, so that its upper surface is situated in a plane identical with that of the upper edge of the strips constituting the grid.

Furthermore in this case the plate-carrier columns of the rammer corresponding to the blocked cavities are removed.

It will be noted that the mechanically laid plates comprise in manufacture a certain number of paving stones separated by a regular interval corresponding to the thickness of the steel strips constituting the moulding grid.

This thickness corresponds to the desired width for the pavement joint, namely 3 to 5 mm. approximately.

Figure 23:
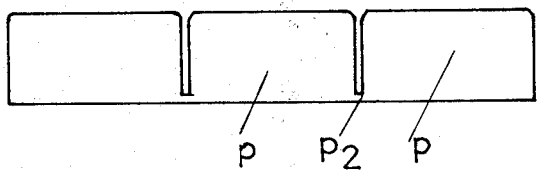
FIG. 23 is a side view of a monolithic slab grooved according to the modules of a pattern.

The grids can advantageously be constructed for moulding not separate paving stones or slabs but one single monolithic slab (FIG. 23) of the whole internal area of the grid and over a certain height p2 from the bottom. The remainder of the height of the monolithic slab is grooved along the lines of the selected modular pattern, by the internal partitions of the grid. This monolithic slab is handled and laid by means of the frame 21 as described above. Since the upper grooves follow the lines of the modules of the pattern, they will surround the suction cups 22 without ever encrouching upon their suction surfaces.

In the compacting of the pavement by a vibrating plate of roller, or otherwise when subjected to traffic, the monolithic slab will break up at the regions of least resistance, so that in the cited case the division of the monolithic slab into individual paving stones or slabs is effected not by the moulding machine but by the vibrating plate or roller or by the traffic itself.

In order to obtain the connection p2 at the bases of the paving stones of slabs, the strips forming the outer edges or periphery of the grid are of normal height while the partitioning strips disposed within the enclosing strips have a lesser height, the reduction of this height being disposed on the side of the bottom of the mould. The space thus created between the plank or sheet or plate constituting the bottom of the mould and the lower edges of the partitioning strips can be filled, in moulding, with concrete which will effect the lower temporary connection between the paving stones or slabs.

The monolithic slab can equally be moulded with recesses corresponding to certain lines of the modular pattern, these recesses being obtained by the process as described above. The spaces thus left in the pavement will subsequently be filled manually by means of paving stones or slabs of corresponding configuration, of the same colour as that of the whole of the pavement or of a different colour.

I claim:

1. Process for the laying of products obtained from an apparatus for molding paving stones or slabs from moldable material, wherein the apparatus comprises a grid member carrier, a unitary grid member of a set of different shaped interchangeable grid members removably mounted on said grid member carrier, said grid member, said carrier, and a bottom plate forming a mold having a plurality of mold cavities, a support member, and a plurality of removable ramming plates mounted on the support member above the grid member, the plates being interchangeable and selected in order that they correspond in shape and dimensions to the shape and dimensions of the underlying mold cavities, said process comprising grasping, transferring and depositing plates composed of individual modular paving stones or slabs or the grooved monolithic modular plates by the handling device provided with a plurality of suction cups, wherein the suction cups are distributed in such manner that their centers correspond to the fixed centers of the modules of the pattern adopted for the construction of the interchangeable grids of the molds which serve for the manufacture of the said plates.

2. Process for the production and laying of paving slabs comrising:

(a) selecting one unitary grid member from a set of interchangeable unitary grid members of dissimilar configuration each having a plurality of through apertures arranged in a pattern with the cavities spaced apart on predetermined centers, (b) mounting said selected grid member on a grid member carrier in association with a bottom plate to form mold cavities, (c) selecting a plurality of ramming plates conforming in shape and dimensions to the cavities of the selected grid member, (d) mounting said ramming plates above said grid member with each plate disposed above its respective cavity, (e) charging said cavities with settable moldable material, (f) thereafter effecting relative movement between said plates and said cavities to effect ramming of the moldable material by said ramming plate, (g) displacing said grid member from said ramming plates, (h) allowing said material to set, (i) providing a handling device with a plurality of suction cups spaced apart in conformity with the pattern of the cavities, (j) contacting said slabs with said suction cups, (k) applying suction to said cups whereby the latter grip the set material, (l) lifting said slabs from the mold cavities, and (m) placing said slabs on a selected site.

3. In a process for molding paving blocks or slabs of concrete in molding apparatus having a mold with plural mold cavities and plural ram members associated with said cavities, the improvement comprising:

changing the size and/or shape of said mold cavities by removing a through-apertured, unitary first grid member from said apparatus and disposing another unitary grid member having a desired configuration in a grid carrier and placing said grid carrier and said another grid member on a mold plate in said molding apparatus to replace said first grid member and removing ram plates from said ram members and replacing them with plates suitable for use in the cavities of said another grid member, said another grid member and said mold plate cooperating to form said plural mold cavities.

4. Process for the laying of products molded by means of the processes according to claim 3, wherein the plates composed of individual modular paving stones or slabs or the grooved monolithic modular plates are grasped and deposited by means of a handling device provided with a plurality of suction cups, wherein these suction cups are distributed in such manner that their centres correspond to the fixed centres of the modules of the pattern adopted for the construction of the interchangeable grids of the mold which served for the manufacture of the said plates.

5. Process for the molding of paving slabs comprising:

(a) selecting one grid member from a set of interchangeable grid members of dissimilar configuration each having a plurality of through apertures arranged in a pattern with the cavities spaced apart on predetermined centers, (b) mounting said selected grid members on a grid member carrier in association with a bottom plate to form mold cavities, (c) selecting a plurality of ramming plates conforming in shape and dimensions to the cavities of the selected grid member, (d) mounting said ramming plates above said grid member with each plate disposed above its respective cavity, (e) charging said cavities with settable moldable material, and (f) thereafter effecting relative movement between said plates and said cavities to effect ramming of the moldable material by said ramming plate.

6. Process for the molding of paving slabs according to claim 5, wherein the selected grid member is mounted on the grid member carrier by interlacing a plurality of strips and securing the ends of said strips whereby the strips of metal extend across the length and breadth of the grid carrier.

7. Process as claimed in claim 5, wherein said grid member is first produced by forming mold cavities by cutting away portions of a metal plate.

8. Apparatus for the molding of paving stones or slabs from moldable material, comprising:

(a) a grid member carrier, (b) a unitary grid member of a set of differently shaped interchangeable grid members removably mounted on said grid member carrier, said grid member, said carrier, and a bottom plate forming a mold having a plurality of mold cavities, (c) a support member, and (d) a plurality of removable ramming plates mounted on said support member above said grid member, which plates are interchangeable and selected in order that they correspond in shape and dimensions to the shape and dimensions of the underlying mold cavities.

9. Apparatus according to claim 8, including partitioning strips disposed within the interlaced strips having a height slightly less than that of the interlaced strips, the reduction of the height being disposed on the side of the bottom of the mold, whereby a temporary frangible connection is formed at the base of the said paving stones or slabs.

10. Apparatus according to claim 8, comprising a frame movable between a position in proximity to said mold cavities and a discharge position remote therefrom, a plurality of suction cups mounted on said frame and distributed in such manner that their centres correspond to the predetermined locations of the cavities, and a suction pump connected to said cups for applying a vacuum thereto during handling and laying of the paving stones or slabs.

11. Apparatus according to claim 8, including columns for mounting the removable ramming plates of the ramming assembly on the plate support member of the rammer, drillings being provided in the support member at positions corresponding to the underlying locations of the cavities of the mold grid, bolts passing through columns disposed between the said plate support and the ramming plates and being screwed into the upper parts of the latter, and means being provided on the plate support and the ramming plates for centring of the plate barrier columns.

12. Apparatus according to claim 11, wherein the means for centering of each plate-carrier column comprises a spigot which is formed on the upper surface of the ramming plate and which locates within the lower end of the column and a circular recess formed in the undersurface of the plate support member, coaxially with each drilling, into which lodgement there fits the upper end of said column.

13. Apparatus according to claim 8, wherein the grid member is assembled with the cavities positioned in relation to predetermined locations, and the removable ramming plates are distributed to correspond to the underlying locations of the cavities of a specific pattern according to which the selected interchangeable grid member is constructed, so that in the constitution of the mold at least one of these predetermined locations may be encompassed within each mold cavity.

14. Apparatus according to claim 13, wherein the interchangeable grid member comprises a plurality of interchangeable interlaced strips extending over the length and breadth of the thus formed grid member.

15. Apparatus according to claim 13, wherein the interchangeable grid member is rigidly featured in the grid member carrier by means of a securing device comprising two lateral bars provided with a lodgement for the heads of securing bolts screwed into the lower part of the sheet of the said grid member carrier, these bars fitting into notches formed in the lower angle of the extremeties of the grid member strips.

16. Apparatus according to claim 15, wherein the securing strips, constituted for example by U-sections, are placed longitudinally fitting into notches formed in the lower angle of the extremities of the short transverse strips.

* * * * *